United States Patent [19]

Broadbent

[11] 4,109,419

[45] Aug. 29, 1978

[54] ICE SKATE SHARPENING DEVICES

[76] Inventor: Sidney Broadbent, 5265 W. Quarles Dr., Littleton, Colo. 80123

[21] Appl. No.: 758,567

[22] Filed: Jan. 12, 1977

[51] Int. Cl.[2] ..... B24B 9/04

[52] U.S. Cl. ..... 51/94 R; 51/100 R; 51/228

[58] Field of Search ..... 51/94 R, 100 R, 102, 51/228; 76/23

[56] References Cited

U.S. PATENT DOCUMENTS

| | | | |
|---|---|---|---|
| 1,335,351 | 3/1920 | Segal | 51/100 R |
| 1,480,422 | 1/1924 | Strom | 51/228 |
| 1,487,142 | 3/1924 | Boker | 51/100 R |
| 3,427,753 | 2/1969 | Hoch | 51/102 X |
| 3,789,551 | 2/1974 | Norris | 51/228 X |
| 3,988,124 | 10/1976 | Babcock | 51/228 X |

*Primary Examiner*—N. P. Godici

[57] ABSTRACT

A lightweight transversely pivoting and longitudinally sliding skate carriage exhibiting exceptionally low friction, introduces a high degree of sensitivity into the process of skate sharpening, facilitating very light grinding cuts and low uniform traversing speeds, enabling a relatively unskilled operator to produce superlative surface finishes and accurately maintain the blade "rocker" profile. The carriage pivotal axis is so located and the skate blade so positioned that the "hollow grind" is accurately centralized throughout the length of the blade. The low friction, pivotal provision enables the blade to be held in sensitive contact with the cutting wheel controlling the depth of cut, whilst the longitudinal sliding provision permits sensitive control of rate of cutting lengthwise along the skate blade. The skate carriage is readily removable and being lightweight facilitates inspection of the blade surface during the course of sharpening. The longitudinal profile or rocker of the blade may be controlled by mounting a template to the carriage parallel to the longitudinal axis, which engages a stationary roller throughout the course of longitudinal travel, thereby replicating the template profile onto the blade during the sharpening operation. Rolling elements may be used on the carriage capable of accommodating both the transversely pivoting and longitudinal motions.

20 Claims, 9 Drawing Figures

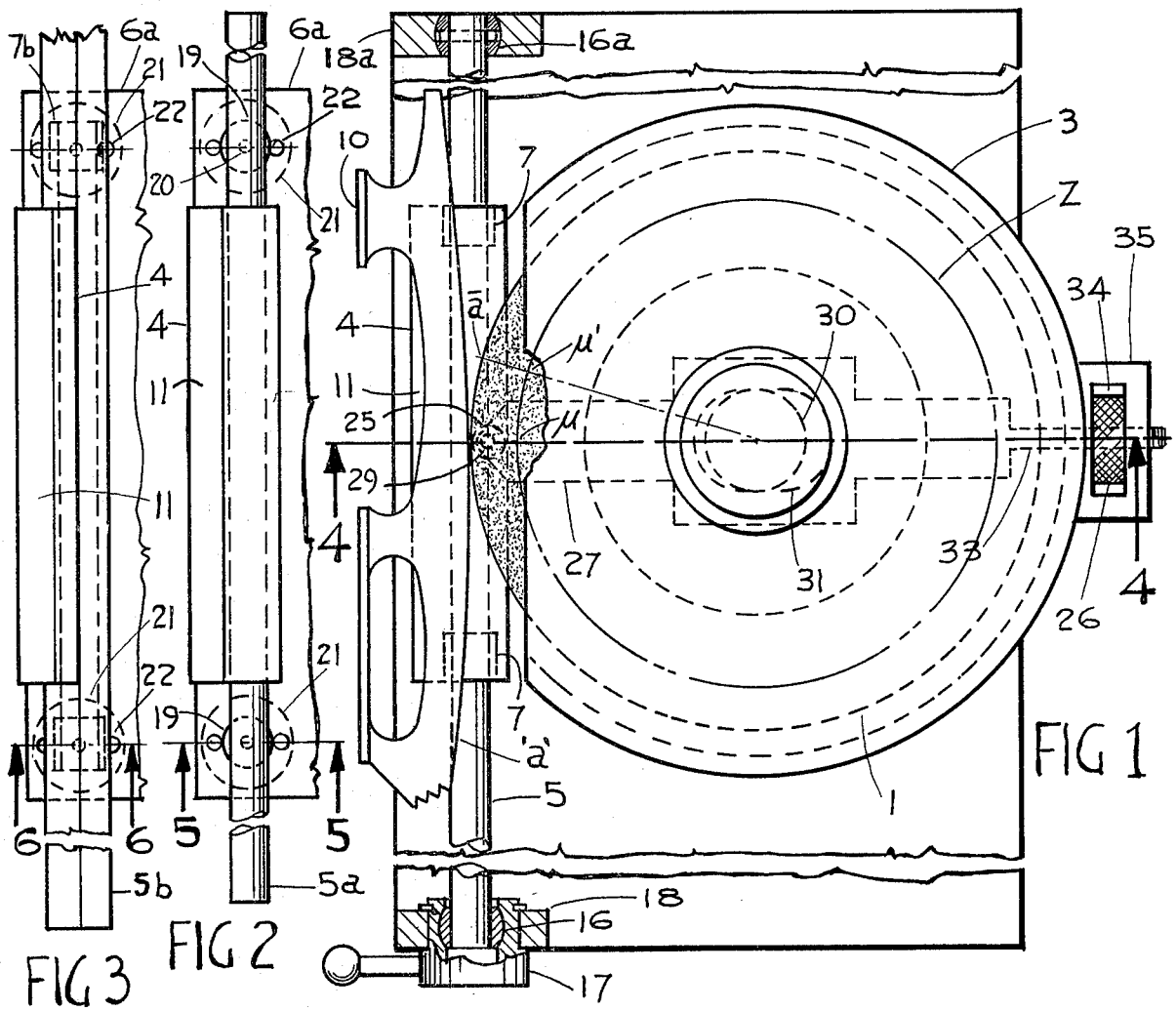
7b
6a
21
19
22
20
18a
16a
10
7
3
Z
35
34
30
4
11
25
29
27
31
33
26
1
5
5b
5a
18
16
17
FIG 1
FIG 2
FIG 3
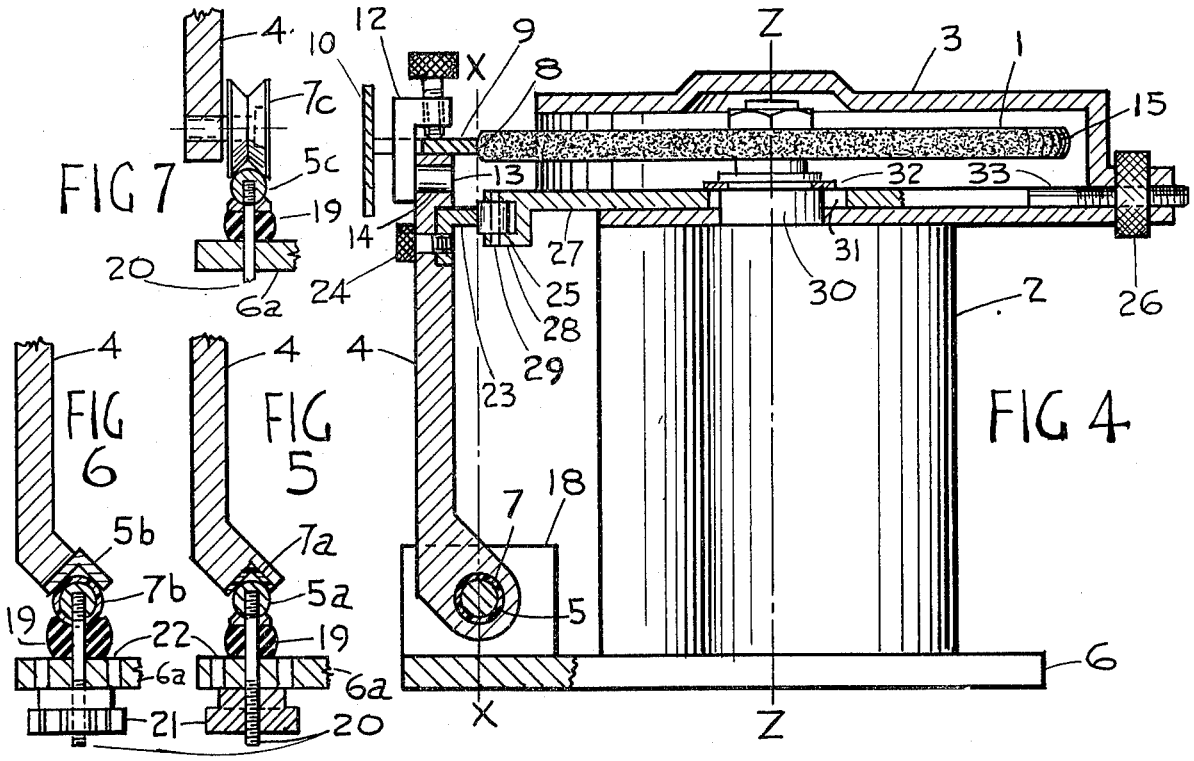
FIG 7
FIG 6
FIG 5
FIG 4
12
9
8
X
Z
3
1
15
7c
5c
19
20
6a
13
14
24
27
25
28
29
23
32
33
31
30
2
26
18
7
5
6
5b
7b
7a
5a
22
21

ICE SKATE SHARPENING DEVICES

BACKGROUND OF THE INVENTION

Conventional methods of sharpening ice skates involve the clamping of the skate blade horizontally to a skate holder, the base of which is provided with a horizontal face of substantial proportions to facilitate sliding engagement with the horizontal worktable of the grinding machine. The actual operation of grinding the blade involves the manual sliding of the skate holder both longitudinally and transversely while maintaining the blade in contact with the periphery of a grinding wheel.

Because of the non-uniform friction at the interface between the sliding skate holder and the worktable, the ability to hold the skate sensitively in contact with the wheel and at the same time maintain constant cutting velocity, in order to effect uniform removal of metal from the blade, is either impossible or requires extreme care and skill. The situation is complicated by the substantial mass of the skate holder interacting with the slip-stick characteristics of the large frictional interface between skate holder and worktable. The presence of abrasive grinding wheel particles in and upon the surface of the worktable and skate holder not only wear and abrade these surfaces but also embed into them and exacerbates the frictional problem. The fact that normally neither surface is hardened is further contributory to this shortcoming. Attempts to use a low friction surfacing to the underside of the skate holder offers temporary relief from this problem but this eventually becomes embedded with grinding paricles and quickly loses its advantages. Neither is the use of oil advantageous, since it retains grinding particles and quickly degenerates into a lapping compound. As a consequence of these shortcomings of current technology skate grinding machines, and particularly the lack of sensitive control over depth of cut and grinding velocity, a skate's original rocker profile is frequently damaged or destroyed or flat portions or flats are introduced, all of which seriously degrade the skate's and the skater's performance.

In addition it is often difficult to achieve the high degree of surface finish and absence of edge "drag" demanded by exacting skaters, without resorting to subsequent hand polishing operations. Not only are these subsequent polishing operations time consuming but they often degrade the keenness of the edge that should have resulted from the sharpening process. Thus the skater does not receive the maximum benefit that he should from the process. In view of the high probability of receiving an unsatisfactory sharpening, many skaters tend to delay having their skates sharpened, preferring to skate on dull edges of the correct profile rather than run the risk of having expensive skates irretrievably damaged. As a result, the proper performance potential of the skate is not being realized.

Another ice skate sharpening concept is that shown in U.S. Pat. No. 1,480,422 intended for the type of skate typical of the period, having a substantially flat, unrockered blade with "curved end portions". In this, the skate-holder or table is longitudinally guided in a manner resembling the invention claimed herein. It will also be noted that a rotary motion about this longitudinal guide is also involved. Such motion however involves an entirely different function from that claimed in this invention, that of controlling skate height; an adjusting screw being provided to facilitate this. Thus, throughout the course of longitudinal travel no radial motion about the longitudinal axis is involved. This rotary action also enabled the skate to be presented and withdrawn to and from the grinding wheel but in no way did it influence the depth of cut. Hence, with the table properly clamped (tightening "Thumb nut 34") the mechanism provided the flat unrockered contour required for the type and vintage of skate involved.

A severe drawback of this concept is the inability to precisely align the blade with the longitudinal guideway. Also the crude method of adjusting the depth of cut is very inadequate when considered in the knowledge that only a few ten thousandths of an inch should be removed during the final grinding processes. Furthermore the concept does not cater to the modern fully rockered blade contour. A fundamental prerequisite for the production of fine surface finishes by rotary cutting means is the selection of the correct type of grinding or cutting wheel used in conjunction with a properly designed bearing arrangement for the wheel spindle. The foregoing shortcomings pertain to situations where wheel and bearing arrangements are totally satisfactory. Satisfactory performance of the disclosed invention is likewise predicated upon the use of properly designed cutting wheel bearings and the correct type of grinding or cutting wheel.

It is also observed that the grinding wheel shown in the accompanying figures, with a profiled periphery for producing the essential "hollow ground" blade surface, though conventional, is not essential to the invention, any other form of abrading means could be adopted. The term cutting wheel will henceforth be adopted in this specification. In regard to the profile of the "hollow grind", this is customarily of circular form since it is almost invariably formed by a diamond pivoting on centers. In the case of the present invention a circular profile to the cutting wheel periphery is essential, as will be explained later. The means of achieving this profile is not further discussed or illustrated since it is merely an incidental feature. However the radius of curvature does need to be adjustable to accommodate the preferences of different classes of skaters and their personal preferences.

SUMMARY OF THE INVENTION

The primary objective of the present invention is to overcome the aforementioned shortcomings of existing sharpening technology and enable fine surface finishes to be produced with ease and without danger of altering the original rocker profile, thus maximizing the useful life of the blade. Another objective is to provide means whereby a damaged rocker profile can be accurately restored. Yet another objective is to provide the foregoing objectives simply and economically together with the elimination of the need for subsequent hand polishing operations.

The present invention accomplishes these objectives by eliminating the conventional worktable and skate-holder and, instead, provides a longitudinal, low friction carriageway upon which a lightweight carriage, carrying the skate, is traversed longitudinally. The small amount of transverse motion necessary to accommodate the rocker contour is provided by allowing the carriage to pivot about an axis parallel to the carriageway during longitudinal motion. A particularly simple solution is to provide the carriageway in the form of a hardened steel rod upon which the carriage may both slide longitudinally and pivot transversely. The bearing surfaces between sliding carriage and the rod are small and manufactured from a low coefficient of friction material such as Teflon and are quickly replaceable, alternately rollers may be incorporated at this interface. A special aspect of the invention is the functional geometrical relationship between the cutting wheel axis, the horizontal guide, the blade and the wheel profile in order to maintain the hollow grind accurately centered within the width of the blades throughout the course of longitudinal travel. This is achieved by locating the axis of the carriageway in a plane approximately parallel to the cutting wheel axis and intersecting the point of contact between the center plane of the blade and the cutting wheel, the skate being located either normal to this plane or at a slight angle to compensate for the arcuate motion of the carriage about the carriageway.

The ability to reproduce a prescribed rocker contour is accommodated by mounting a suitably profiled template to the carriage such that during the course of longitudinal travel it may be manually constrained to engage a stationary roller on the machine structure, throughout the course of longitudinal travel, thereby imparting a predetermined transverse displacement to the carriage relative to the grinding wheel. Positional adjustments to the stationary roller, controls the depth of grind until the complete template profile is reproduced upon the skate blade.

Referring to the drawings:

FIG. 1 is a plan view with broken sections showing details of structural arrangements for anchoring the guide rod which is used as a carriageway. The skate mounting clamps shown in FIG. 4 are omitted for clarity.

FIG. 2 is a partial plan view showing an alternate structure for mounting a guide rod type of carriageway. The skate is omitted for clarity.

FIG. 3 is a partial plan view wherein an inverted V carriageway forms an integral part of the carriage. The skate is omitted for clarity.

FIG. 4 is a sectional elevation of FIG. 1 taken along the plane of line 4—4.

FIG. 5 is a partial sectional elevation of FIG. 2 taken along the plane of line 5—5.

FIG. 6 is a partial sectional elevation of FIG. 3 taken along the plane of line 6—6.

FIG. 7 is a partial sectional elevation similar to FIG. 5 but using vee rollers instead of sliding interfaces.

DESCRIPTION OF PREFERRED EMBODIMENTS

The following will assume that the axis ZZ of the cutting wheel spindle is located vertically.

Figure 8:
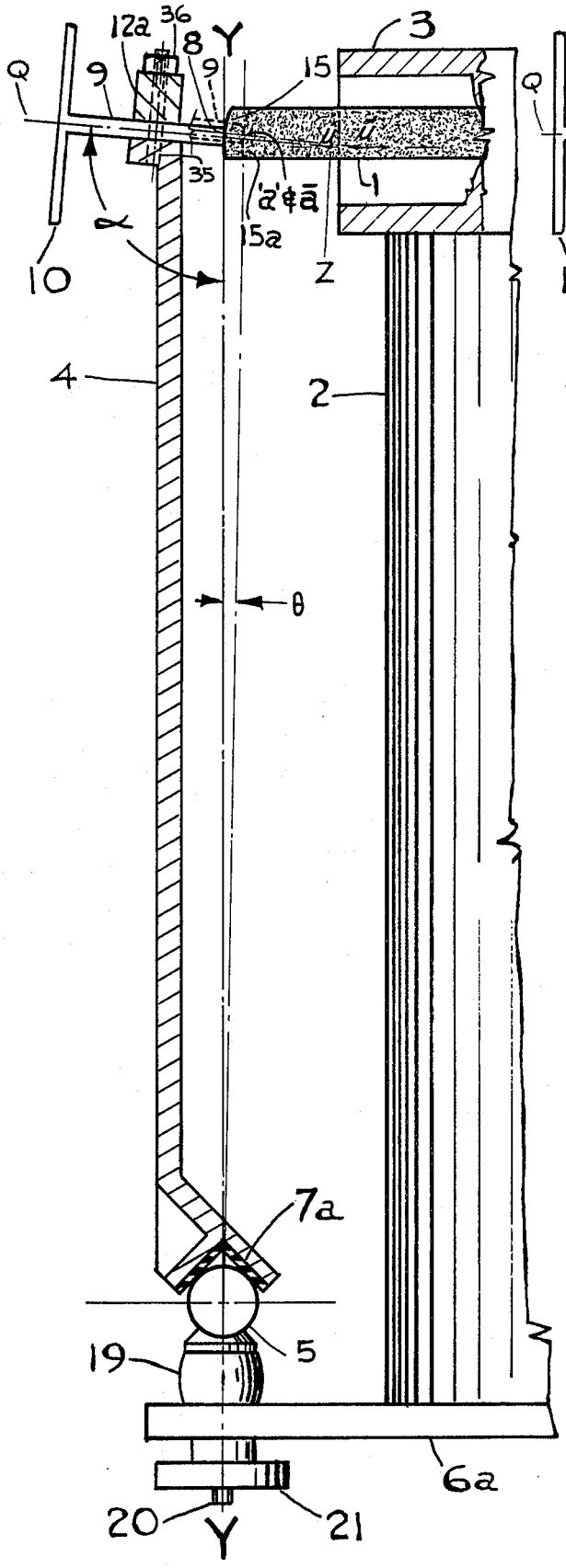
FIG. 8 is a partial sectional elevation taken along the plane of line 4—4, showing the effect of canting the blade with respect to intercept YY, angle $\theta$ exaggerated.
Figure 9:
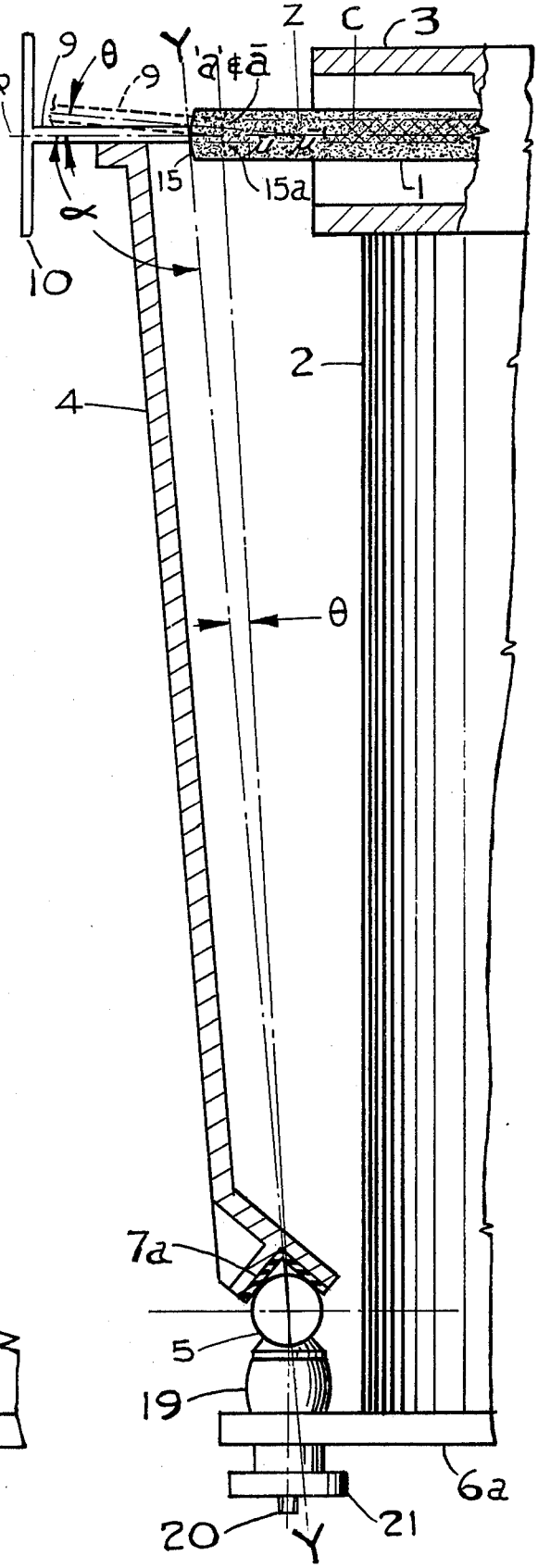
FIG. 9 is a partial sectional elevation taken along the plane of line 4—4 of an alternate structure for achieving the same effect demonstrated in FIG. 8, angle $\theta$ exaggerated.

FIGS. 1 and 4 illustrate the basic structure of the invention with a main frame 2 containing a spindle either belt driven or directly driven by an electric motor. The wheel enclosure 3 which mounts to the frame 2 is incorporated for safety purposes and is quite conventional. The unique aspects of the invention are associated with the carriage 4 and its carriageway 5, **5*a* or 5*b* which in FIGS. 1, 2, 4, 5 and 6 consists of a circular section guide rod mounted to the baseplate 6 with provision for height adjustment. The carriage 4 rides longitudinally on this guide rod using low friction bearing surfaces 7; it is also free to pivot transversely throughout the course of longitudinal travel on these same bearing surfaces. Since the radial distance of the skate blade 9 from the pivot center of the guide rod 5 is many times greater than the radius of the interface of bearing 7 and guide rod 5 the effort to overcome bearing pivotal friction is very low and thus permits the skating surface 8 to be held very sensitively in contact with the cutting wheel 1, facilitating very light grinding cuts and producing fine surface finishes. The preferred geometrical relationship is shown basically in FIG. 4 wherein the pivotal axis of the carriage lies in a plane through XX which intersects the point of contact between the centerplane of the blade and the cutting wheel's peripheral profile at the point of contact between blade and wheel. In this figure the plane XX is shown parallel to the grinding wheel axis ZZ and the blade is shown normal to this axis; alternate geometries are illustrated in FIGS. 8 and 9. In this construction the blade is shown normal to the plane through XX for clarity in illustrating the basic structure. FIGS. 8 & 9** show refinement to this geometry which will be explained later in the text.

The skate 10 may be clamped to the upper face 11 of the carriage 4 using any convenient means. FIG. 4 illustrates a form of C clamp 12 having a cylindrical reaction members 13, which can be selectively engaged with one of a plurality of holes 14 enabling clamps to be positioned to accommodate different lengths of skate. Since the thicknesses of skate blades vary dependent on manufacturer and quality and type of skates, provision must be made for adjusting the height of the skate relative to the cutting wheel 1. In FIG. 1 this is accomplished by mounting one end of the guide rod 5 in an eccentrically mounted spherical bearing 16, this being achieved by incorporating the spherical bearing 16 eccentrically within the trunnion 17. Height adjustment is thereby achieved by rotating the trunnion within the bore provided in block 18. The sideways motion that accompanies such height adjustment is of no concern but must be accommodated, for instance by use of another spherical bearing **16*a* at the far end of the guide rod 5, housed in the block 18*a***.

FIGS. 2 and 5 illustrate an alternate form of guide rod height adjustment in association with a different kind of bearing **7*a* of A configuration which permits the skate carriage 4 to be readily removed from the machine. This facility permits any number of skate carriers to be used with one machine thereby avoiding machine down time since an unskilled assistant can be mounting skates onto spare carriers while the machine is in constant use. Obviously, any configuration of bearing having no more than 180° circumferential engagement of the guide rod 5 will offer this facility. The method of height adjustment in FIGS. 2, 3, 5, 6 and 7 is particularly simple, involving elastic members 19, each held in compression by a stud 20 threaded into a guide rod 5*a*, 5*b* or 5*c*, extending through the elastic member 19 and through the baseplate 6*a*, then engaging a threaded adjustment knob 21 which reacts against the underside of the baseplate. A very exacting height adjustment is achieved by turning the knob 21 whilst the compressed elastic member 19 provides rigidity to the guide rod without bending it. It will also be perceived that these mounting means can be much more closely spaced resulting in a much smaller mounting plate 6*a*, FIGS. 2, 3, 5 and 7** show a simple method of incrementally adjusting the position of the guide rod 5*a* relative to the grinding wheel 1 to compensate for wheel wear, comprising of the holes 22 in which the studs 20 may be alternatively located, relocating one stud only at a time.

FIGS. 3 and 6 illustrate an inversion of the previously described carriageway concepts wherein an inverted vee carriageway 5*b* forms part of the carriage 4 riding on spaced circular bearings 7*b* each capable of height control as previously described.

FIG. 7 shows a rolling element 7*c* as the bearing interface between the carriage 4 and guide rod 5*c* as a substitute for members 7, 7*a* or 7*b*.

The various figures all illustrate the invention adapted to a vertical cutting wheel spindle but such an arrangement is not essential. A particularly advantageous configuration is where the wheel spindle is tilted rearward such that the center of gravity of the skate carrier and the attached skate and boot is vertically above the guide rod axis. By this means the machine operator has maximum sensitivity of control of the sharpening process, since he does not have to contend with the overhung weights of the boot, skate 9 and carrier 4.

FIGS. 8 and 9 show alternate versions of the same basic structural refinement which utilizes the arcuate motion of the blade to achieve accurate centralization of the "hollow grind" within the blade thickness throughout the length of the blade. This consists of mounting the blade at an angle somewhat greater than 90°, to the plane through YY and the guide rod axis. The resulting effect is best explained by referring in FIG. 4 to: (i) the location '*a*' in the center plane of the blade on surface 8, representative of any other such location along the length of the blade surface 8, (ii) the locus circle Z on which the radius of the wheel profile 15 is centered, (iii) the location $\bar{a}$ on the cutting wheel, where '*a*' makes contact; $\bar{a}$ being representative of any other such location on either side of the line 4—4, and (iv) any lucus $\mu$ on circle Z of any element of the wheel profile 15 which embraces a location $\mu'$, such loci falling on either side of line 4—4. Now refer to FIGS. 8 and 9. The angle $\alpha$ is selected such that when any point '*a*' makes contact with its mating location $\bar{a}$ on the wheel profile 15*a*, the centerplane of the blade, Q, when extended, accurately intersects both $\bar{a}$ and $\mu'$, for a given arcuate travel $\theta$. FIGS. 8 and 9 show this situation with the blade illustrated in dotted line. Obviously for this process to be effective the wheel profile 15 must be circular. The value of $\alpha$ is influenced by wheel diameter and blade height above the axis of the carriageway 5; for example, using cutting wheel diameters from 8 inches to 10 inches and a blade height of 15 inches, an angle $\alpha$ of 93.5° provides excellent centering of the "hollow grind". Item 12*a* in FIG. 8 is an alternate skate clamping member using studs 35 and nuts 36.

The above referenced "blade height" may also be described as the "predetermined radius" separating blade from pivotal axis.

A further aspect of this invention is that it may be furnished as part of a sharpening machine, complete with cutting wheel, spindle and drive, or, alternately the unique features of the invention such as the carriage 4 and carriageway 5, could be provided together with skate clamping means and height adjustment provision for attachment to an existing cutting wheel, spindle and drive assembly.

FIGS. 1 and 4 show an ancillary feature which permits reprofiling of the longitudinal blade profile or rocker. This feature involves the incorporation of a template 23 attached to the carrier 4 and fastened thereto by means of screws 24. The profile of template 23 is such to reproduce the required profile upon the blade surface 8 i.e. it is duly compensated for the arcuate motion of the carrier 4 about the carriageway 5, 5*a* or 5*b*. The template is caused to engage a roller 25 by manual pressure applied at blade level on the carrier 4 toward the cutting wheel 1. The position of the roller 25 governs the proximity of the blade surface to the cutting wheel which is controlled by means of adjustment knob 26. The connection between the adjustment knob 26 and the roller 25 consists of the slide 27 which incorporates a yoke 28 at the front to support the roller 25 using bearing pin 29. The slide carries diametrically across and beneath the grinding wheel 1, spanning the neck 30 of the frame 2 using a slot 31. A retaining ring 32 retains this slide in position. The rear of the slide is formed into a spindle 33 with threaded engagement with the adjustment knob 26. The adjustment knob 26 resides in a slot 34 in a rearward extension of the cover 35 such that by rotating the knob 26 the position of the roller 25 is moved so as to cause either lesser or greater removal of metal from the blade surface 8.

The cutting wheel, spindle and drive assembly previously discussed constitute the cutting wheel head referenced in the following claims. The zone of contact, C, between blade and cutting wheel, including effects of arcuate blade motion, is identified in FIG. 9.

Having described the invention, the following is claimed:

1. A skate sharpening device comprising: a driven cutting wheel having a peripheral surface which is an arc of revolution about the cutting wheel's axis; a linear carriageway parallel to the plane of rotation of the cutting wheel; a carriage in longitudinally guided engagement with the carriageway, having skate attachment means clamping the skate in fixed location relative to the carriage with the centerplane of the blade parallel to the carriageway; unrestricted pivotal means for the carriage during sharpening, about an axis in fixed location, permitting transverse motion of the carriage and attached skate, and the centerplane of the blade regardless of its angular motion, to reside normal to the peripheral profile of the cutting wheel at any location of the carriage along the length of the carriageway, with the blade's hollow arcuate skating surface in accurate cutting contact with said peripheral profile of the cutting wheel.

2. The device of claim 1 wherein a contoured template is attached to the carriage at a radial distance from the pivotal axis, less than that of the skate blade, the template contour in engagement with a transversely adjustable roller in fixed longitudinal location during the course of sharpening, causing replication of the template profile upon the skate blade surface, said profile scaled in relationship to the required profile in proportion to the ratio of its distance from the pivotal axis and blade distance from same axis, and including profile correction to accommodate the effect of a longitudinally fixed roller versus a longitudinally varying contact point between skate and cutting wheel.

3. The device of claim 1 wherein: the carriageway comprises a straight, circular or part circular cross section guide rod by which the skate carriage is guided using bearing surfaces that interface with the circular periphery of the guide rod and constrain the carriage to pivot about an axis in fixed location, thereby providing the pivotal function.

4. The device of claim 3 wherein the said bearing surfaces interface with the circular periphery of the guide rod at locations spaced less than 180° around said circular cross section so that the weight of the carriage eliminates bearing play at these interfaces.

5. The device of claim 1 wherein: an adjustment is incorporated to modify the spacing between the plane of rotation of the cutting wheel and the carriageway in order to position the required "hollow grind" centrally in the thickness of the blade, said adjustment maintaining parallelism between the carriageway and the plane of rotation of the cutting wheel.

6. The device of claim 5 wherein: the height adjustment involves movement of the carriageway relative to the cutting wheel.

7. The device of claim 3 wherein: the guide rod is provided with positional adjustment means relative to the cutting wheel to enable the cutting wheel profile to be centralized within the blade thickness.

8. The device of claim 1 wherein: the linear carriageway comprises a straight cylindrical or partly cylindrical guide rod in longitudinally rolling engagement and transversely pivotal sliding engagement with a plurality of grooved rollers mounted on the carriage thereby providing said pivotal means for the carriage about an axis in fixed location, the cylindrical surfaces of said guide rod engaging both flanks of the grooved rollers simultaneously to eliminate bearing play at these interfaces.

9. A skate sharpening device comprising a driven cutting wheel having a peripheral surface which is an arc of revolution about the cutting wheel's axis; a unitary skate carriage and linear carriageway complete with skate clamping means and bearing surfaces for mating with stationary bearings, said bearings and bearing surfaces permitting both longitudinal motion and transverse pivotal motion of said unitary carriage and carriageway about an axis in fixed location parallel to the plane of rotation of the cutting wheel and the centerplane of the blade to reside normal to the peripheral profile of the cutting wheel at any location along the blade's length with the blade's hollow arcuate skating surface in accurate cutting contact with said peripheral surface of the cutting wheel.

10. A skate sharpening device comprising: a driven cutting wheel having a peripheral surface which is an arc of revolution about the cutting wheel axis; a linear carriageway parallel to the plane of rotation of the cutting wheel; a carriage in longitudinally guided engagement with the carriageway, having skate attachment means locating the centerplane of the blade parallel to the carriageway; unrestricted pivotal means for the carriage about an axis in fixed location, permitting transverse motion of the carriage and attached skate during sharpening, and the centerplane of the blade to reside normal to the peripheral profile of the cutting wheel at any location of the carriage along the length of the carriageway, with the blade's hollow arcuate skating surface in accurate cutting contact with said peripheral profile of the cutting wheel, the pivotal axis of said pivotal means located at and extending through the intersection of multiple planes, each plane intersecting a different point of tangency between the blade's longitudinal contour at the blade's centerplane and the cutting wheel's peripheral profile, all such planes lying at the same angle to the blade's centerplane.

11. The device of claim 10 wherein: a contoured template is attached to the carriage at a radial distance from the pivotal axis, less than that of the skate blade, the template contour in engagement with a transversely adjustable roller in fixed longitudinal location, during the course of sharpening, causing replication of the template profile upon the skate blade surface, said profile scaled in relationship to the required profile in proportion to the ratio of its distance from the pivotal axis and blade distance from same axis, and including profile correction to accommodate the effect of a longitudinally fixed roller versus a longitudinally varying contact point between skate and cutting wheel.

12. The device of claim 10 wherein: the carriageway comprises a straight, circular or part circular cross section guide rod by which the skate carriage is guided using bearing surfaces that interface with the circular periphery of the guide rod and constrain the carriage to pivot about an axis in fixed location, thereby providing the pivotal function.

13. The device of claim 12 wherein the said bearing surfaces interfaces with the circular periphery of the guide rod at locations spaces less than 180° around said circular cross section so that the weight of the carriage eliminates bearing play at these interfaces.

14. The device of claim 10 wherein an adjustment is incorporated to modify the spacing between the plane of rotation of the cutting wheel and the carriageway in order to position the required "hollow grind" centrally in the thickness of the blade, said adjustment maintaining parallelism between the carriageway and the plane of rotation of the cutting wheel.

15. The device of claim 10 wherein the height adjustment involves movement of the carriageway relative to the cutting wheel.

16. The device of claim 12 wherein the guide rod is provided with positional adjustment means relative to the cutting wheel to enable the cutting wheel profile to be centralized within the blade thickness.

17. An ice skate sharpening machine comprising: a driven cutting wheel in fixed location having a peripheral surface which is an arc of revolution about the cutting wheel axis, a removable skate carriage with skate attachment means and bearing surfaces mating with linear guideways on the machine positioned parallel to the plane of rotation of the cutting wheel and pivotal means for the carriage permitting transverse motion of the carriage during the course of sharpening about an axis in fixed location parallel to the guideways the skate so mounted that the center plane of the blade lies parallel to said guideways and clamped in such fixed orientation that an extension of said centerplane accurately intersects the locus of curvature of the cross sectional periphery of the cutting wheel at the place of engagement with the blade, for any location of cutting contact throughout the length of the blade.

18. The machine of claim 17 wherein the guideways comprised the surface of a circular or part circular cross sectional guide rod having position adjustment means to adjust the proximity of the skate to the cutting wheel, such means maintaining parallelism of the guideways with respect to the plane of rotation of the cutting wheel, and said bearing surfaces interfacing with the cylindrical guideways of the guide rod to serve for both longitudinal and pivotal motion of the carriage.

19. An ice skate sharpening machine comprising: a driven cutting wheel in fixed location having a peripheral surface which is an arc of revolution about the cutting wheel axis, a skate carriage with skate attachment means guided longitudinally by means of a linear carriageway parallel to the plane of rotation of the cutting wheel, pivotal means for the carriage about an axis in fixed location and parallel to the carriageway, permitting transverse motion of the carriage and skate, the skate so mounted that its centerplane lies parallel to the carriageway and so oriented that during the course of sharpening the accompanying pivotal motion of the blade about said axis constrains the concave skating surface of the blade to accurately conform to the arcuate peripheral profile of the cutting wheel while traversing within the zone of contact.

20. The machine of claim 19 wherein: the linear carriageway comprises a straight cylindrical or partly cylindrical guide surface in longitudinally rolling engagement and transversely pivotal sliding engagement with a plurality of grooved rollers thereby providing said pivotal means for the carriage about an axis in fixed location, the cylindrical surfaces of said guide rod engaging both flanks of the grooved rollers simultaneously to eliminate bearing play at these interfaces.

* * * * *